US008020302B2

(12) United States Patent
Kao

(10) Patent No.: US 8,020,302 B2
(45) Date of Patent: Sep. 20, 2011

(54) FOLDING KNIFE HAVING A POKING ELEMENT

(76) Inventor: Chih-Chen Kao, Taoyuan (TW)

( * ) Notice: Subject to any disclaimer, the term of this patent is extended or adjusted under 35 U.S.C. 154(b) by 174 days.

(21) Appl. No.: 12/003,248

(22) Filed: Dec. 21, 2007

(65) Prior Publication Data

US 2009/0126200 A1 May 21, 2009

(30) Foreign Application Priority Data

Nov. 21, 2007 (TW) ..... 96219642 U

(51) Int. Cl.
*B26B 3/06* (2006.01)

(52) U.S. Cl. ..... 30/155; 30/158; 30/159

(58) Field of Classification Search ..... 30/158, 30/159, 153, 155
See application file for complete search history.

(56) References Cited

U.S. PATENT DOCUMENTS

| | | | | | |
|---|---|---|---|---|---|
| 249,896 | A * | 11/1881 | Chamberlain | 30/158 |
| 412,799 | A * | 10/1889 | Schenck | 30/158 |
| 533,219 | A * | 1/1895 | Hardy | 30/158 |
| 616,689 | A * | 12/1898 | Ruettgers | 30/158 |
| 689,513 | A * | 12/1901 | Papendell | 30/158 |
| 698,080 | A * | 4/1902 | Treas | 30/159 |
| 1,022,494 | A * | 4/1912 | Minter | 30/158 |
| 1,075,519 | A * | 10/1913 | Tillmanns | 30/159 |
| 1,087,788 | A * | 2/1914 | Larsen | 30/159 |
| 1,234,345 | A * | 7/1917 | Keeran | 30/158 |
| 1,319,532 | A * | 10/1919 | Rasmussen | 30/159 |
| 1,440,793 | A * | 1/1923 | Rasmussen | 30/159 |
| 1,810,031 | A * | 6/1931 | Schrade | 30/159 |
| 1,810,999 | A * | 6/1931 | Brown | 30/159 |
| 5,297,340 | A * | 3/1994 | Kahlcke | 30/158 |
| 5,331,741 | A * | 7/1994 | Taylor, Jr. | 30/158 |
| 5,896,665 | A * | 4/1999 | Harris | 30/158 |
| 6,338,431 | B1 * | 1/2002 | Onion | 30/161 |
| 6,651,344 | B2 * | 11/2003 | Cheng | 30/159 |
| 7,080,457 | B2 * | 7/2006 | Sullivan | 30/160 |
| 7,086,157 | B2 * | 8/2006 | Vallotton | 30/159 |
| 7,124,509 | B1 * | 10/2006 | Hawk | 30/159 |
| 7,146,736 | B1 * | 12/2006 | Collins | 30/159 |
| 7,275,321 | B2 * | 10/2007 | Cheng | 30/158 |
| 7,284,329 | B1 * | 10/2007 | King | 30/158 |
| 7,302,760 | B2 * | 12/2007 | Lake | 30/159 |
| 7,513,045 | B2 * | 4/2009 | Kain | 30/158 |
| 7,886,444 | B2 * | 2/2011 | Kao | 30/159 |
| 2003/0140500 | A1 * | 7/2003 | Cheng | 30/159 |
| 2006/0059694 | A1 * | 3/2006 | Carter, III | 30/159 |
| 2006/0288585 | A1 * | 12/2006 | Kao | 30/159 |
| 2008/0276462 | A1 * | 11/2008 | Kao | 30/155 |
| 2008/0276463 | A1 * | 11/2008 | Kao | 30/155 |
| 2009/0144985 | A1 * | 6/2009 | Liu | 30/158 |
| 2009/0183374 | A1 * | 7/2009 | Kao | 30/159 |
| 2009/0183375 | A1 * | 7/2009 | Kao | 30/159 |
| 2009/0217533 | A1 * | 9/2009 | Kao | 30/159 |
| 2009/0265939 | A1 * | 10/2009 | Chu | 30/159 |
| 2010/0218383 | A1 * | 9/2010 | Williams | 30/158 |

* cited by examiner

*Primary Examiner* — Jason Daniel Prone
(74) *Attorney, Agent, or Firm* — Bacon & Thomas, PLLC

(57) ABSTRACT

A folding knife includes a handle, a blade, a resilient element and a poking element. The blade can be turned into or out from the handle. The resilient element has an end fixed to the handle and another end extended to a position of connecting the handle and the blade. If the blade is stored in the handle, the resilient element produces a torque to turn the blade into the handle. When a force is applied to turn the blade out from the handle, the resilient element produces a torque to pop the blade out from the handle automatically. The poking element is provided for turning the blade. When the blade is in the handle, the poking element presses against the blade, such that if a user pokes an end of the poking element, another end of the poking element turns the blade out from the handle.

2 Claims, 7 Drawing Sheets

FOLDING KNIFE HAVING A POKING ELEMENT

FIELD OF THE INVENTION

The present invention relates to a folding knife, and more particularly to a folding knife having a poking element provided for turning a blade into or out from a handle of the folding knife.

BACKGROUND OF THE INVENTION

Various folding knives available in the market are composed of a handle and a blade, and an end of the blade is pivotally coupled to an end of the handle, such that the blade can be rotated along its pivoting position and turned out from the handle, or turned and stored into the handle. If a user wants to use the folding knife, the user needs to hold the handle by one hand while pulling the blade by another hand to turn the blade out of the handle. However, a major drawback of this type of folding knives resides on that users have to use both hands to turn the blade out form the handle. If a user encounters a special or emergency situation and has only one hand available, then the user cannot use the folding knife to handle the emergency situation. For instance, if a diver's hand is tangled by a fish net while the diver is diving, the diver will not be able to use the folding knife to cut the fish net immediately by the other hand, and thus causing a fatal threat to the diver.

To overcome the aforementioned drawback, a design of a spring knife as shown in FIG. 1 is disclosed in U.S. Pat. No. 6,338,431. The spring knife includes a handle 20 and a blade 21, wherein the handle 20 is provided for containing the blade 21, and a lateral side of the blade 21 has a blade portion 211, and an end of the blade portion has a pivoting portion 221 pivotally coupled with an axle rod 22 that is disposed at an end of the handle 20, so that the blade 21 can be moved along the pivoting position and turned into or out from the handle 20, and the handle 20 includes a resilient element 23, and an end of the resilient element 23 is fixed to a position proximate to another end of the handle 20, and another end of the resilient element 23 is extended and fixed onto the blade 21 and at a position proximate to the pivotal connection of the handle 20 and the blade 21, such that when the blade 21 is stored completely into the handle 20, the resilient element 23 will produce a torque in a direction of turning the blade 21 into the handle 20, and the blade 21 can be stored securely into the handle 20. If a force is applied to the blade 21 to turn the blade 21 to a predetermined angle and out from the handle 20, the resilient element 23 will produce a torque to turn the blade 21 in a direction out of the handle 20, so that the blade 21 will pop out of the handle 20 automatically. In U.S. Pat. No. 6,338,431, a protruding portion 212 is protruded from a lateral side of a blade portion 211 of the blade 21 and disposed proximate to a pivotally connecting position of the handle 20 and the blade 21 to facilitate users to operate the spring knife. If the blade 21 is stored completely into the handle 20, the protruding portion 212 is passed through a lateral side of the handle 20 opposite to the blade 21 and protruded out of the handle 20, and thus the height and size of the protruding portion 212 must be designed in such a way that after a user presses the protruding portion 212, a force is exerted onto the blade 21 to turn the blade 21 out from the handle 20 with an angle equal to or greater than the predetermined angle. Therefore, the resilient element 23 can produce a torque to turn the blade 21 out from the handle 20, and the blade 21 can be popped out from the handle 20 automatically.

According to the design of the U.S. Pat. No. 6,338,431, the blade 21 on the spring knife requires a protruding portion 212 with specific height and size, but such design not only destroys the aesthetic appearance of the blade 21, but also limits the moving direction of the blade 21. Since the protruding portion 212 is passed through a lateral side of the handle 20 and situated precisely at the position where the user is holding the handle 20, therefore if the user wants to hold the handle 20 by one hand while pressing the protruding portion 212 to pop the blade 21 out from the handle 20 automatically, the user must adjust the holding angle significantly to reserve a space to facilitate the user's thumb or index finger to press the protruding portion 212. Such arrangement not only makes it difficult for the user to operate the folding knife, but also has the risk of causing accidents easily since the user cannot hold the handle 20 by one hand easily, and the spring knife may fall from the user's hand. By then, the user has only one free hand available and cannot handle the emergency situation by quickly and successfully using the spring knife.

In addition to the aforementioned functions, knife designers and manufacturers also need to take the humanistic side into consideration for the research and development to design an easy-to-operate and safe knife. Therefore, it is an important subject of the invention to design a safe and easy-to-operate spring knife.

SUMMARY OF THE INVENTION

In view of the shortcomings of the prior art, the inventor of the present invention based on years of experience in the related industry to conduct extensive researches and experiments, and finally developed a folding knife having a poking element in accordance with the present invention to overcome the aforementioned shortcomings.

It is a primary objective of the present invention to provide a folding knife having a poking element, and the folding knife comprises a handle, a blade, a resilient element and a poking element, wherein an end of the blade is pivotally coupled to an end of the handle, so that the blade can be moved along a pivoting position and turned into or out from the handle, and an end of the resilient element is fixed to a position proximate to another end of the handle, and another end of the resilient element is extended to a position proximate to the pivotally connecting position of the handle and the blade, such that when the blade is stored completely into the handle, the resilient element produces a torque to turn and store the blade securely into the handle. When a force is applied to the blade to turn the blade out from the handle to a predetermined angle, the resilient element produces a torque to turn the blade out of the handle, so that the blade can be popped out from the handle automatically. The poking element is pivotally coupled to the handle and disposed proximate at the pivotally connecting position of the handle and the blade, and an end of the poking element is extended out from the handle and provided for users to turn-the blade. When the blade is stored completely into the handle, another end of the poking element presses against the blade, such that when the user pokes an end of the poking element, another end of the poking element exerts a force onto the blade, and the blade is turned out from the handle to the predetermined angle. When a user holds the handle by one hand while using a finger to poke the poking element, the user does not need to adjust the holding angle to reserve a space for popping the blade out of the handle automatically, and the user can quickly and successfully use the folding knife to handle the emergency situation. Thus, the present invention can greatly enhance the convenience and safety of using the folding knife.

To make it easier for our examiner to understand the objective, technical characteristics and effects of the present invention, preferred embodiments will be described with accompanying drawings as follows.

DETAILED DESCRIPTION OF THE PREFERRED EMBODIMENTS

Figure 1:
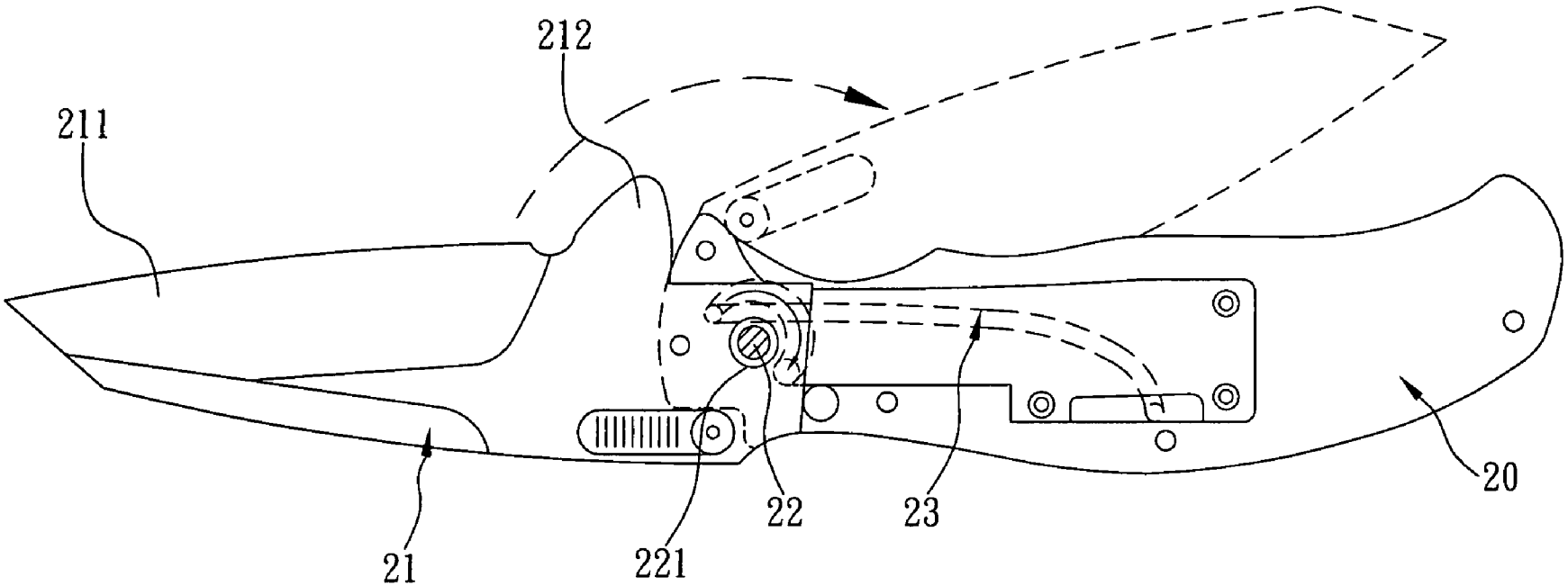
FIG. 1 (Prior Art)
FIG. 1 is a section view of a spring knife as disclosed in U.S. Pat. No. 6,338,431.
Figure 2A:
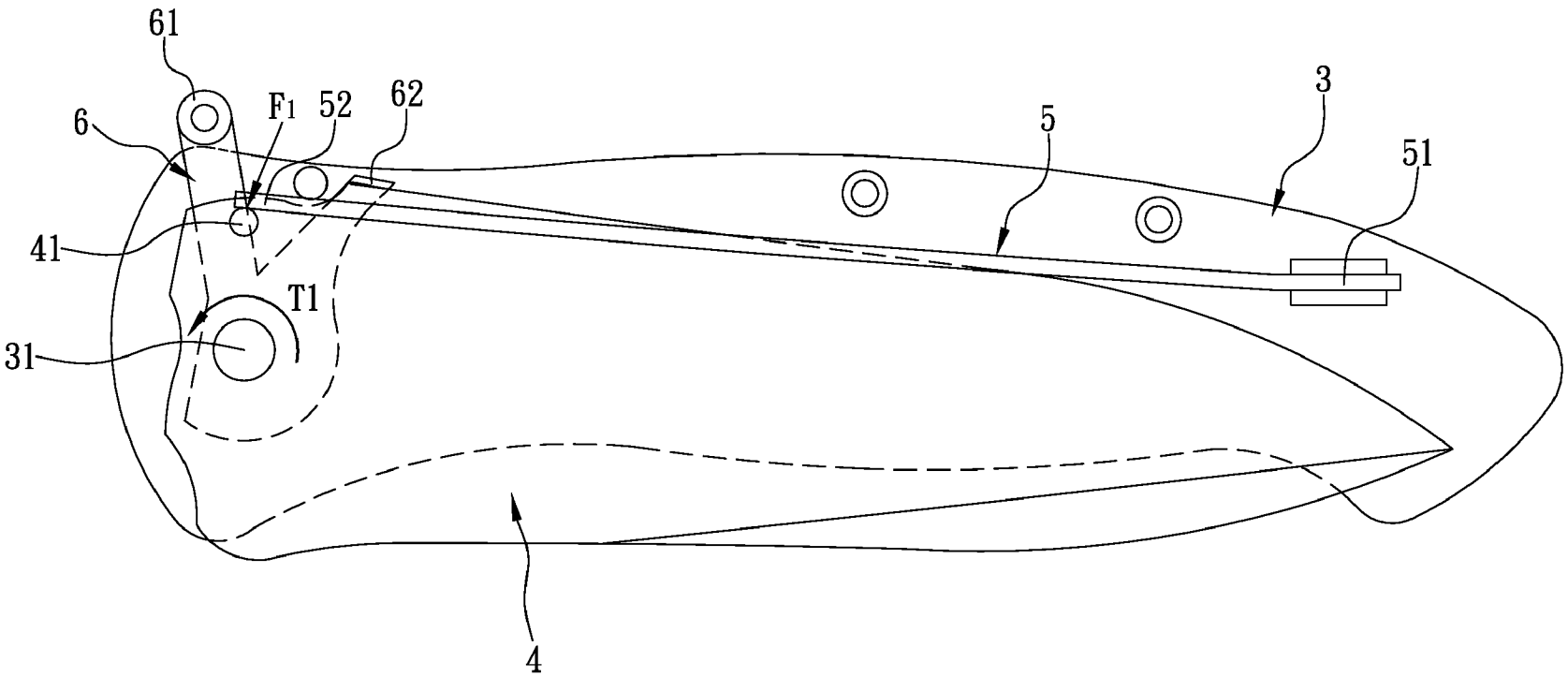
FIGS. 2A and 2B is a section view of a folding knife being folded in accordance with a first preferred embodiment of the present invention.
Figure 2B:
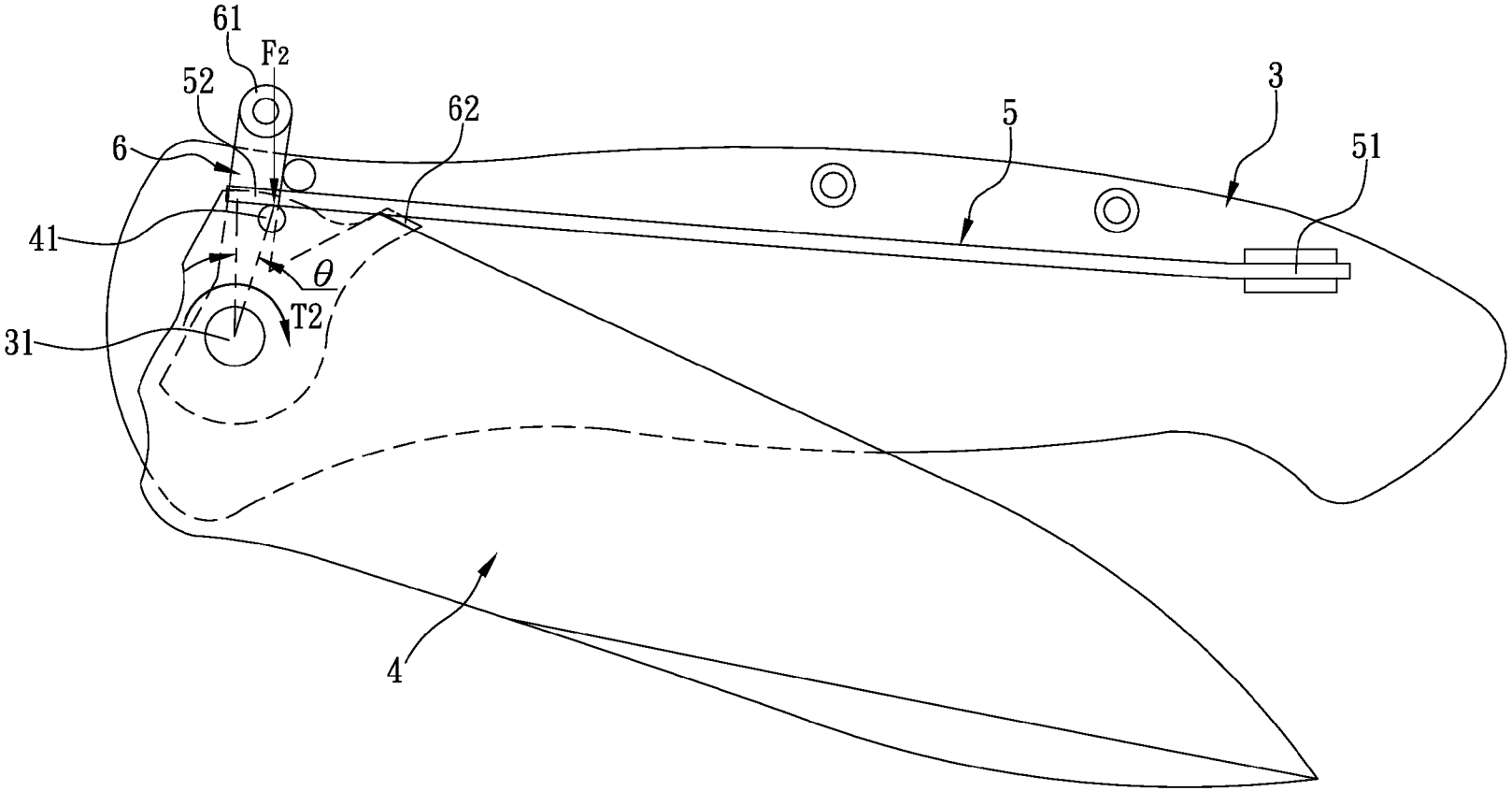
Figure 3:
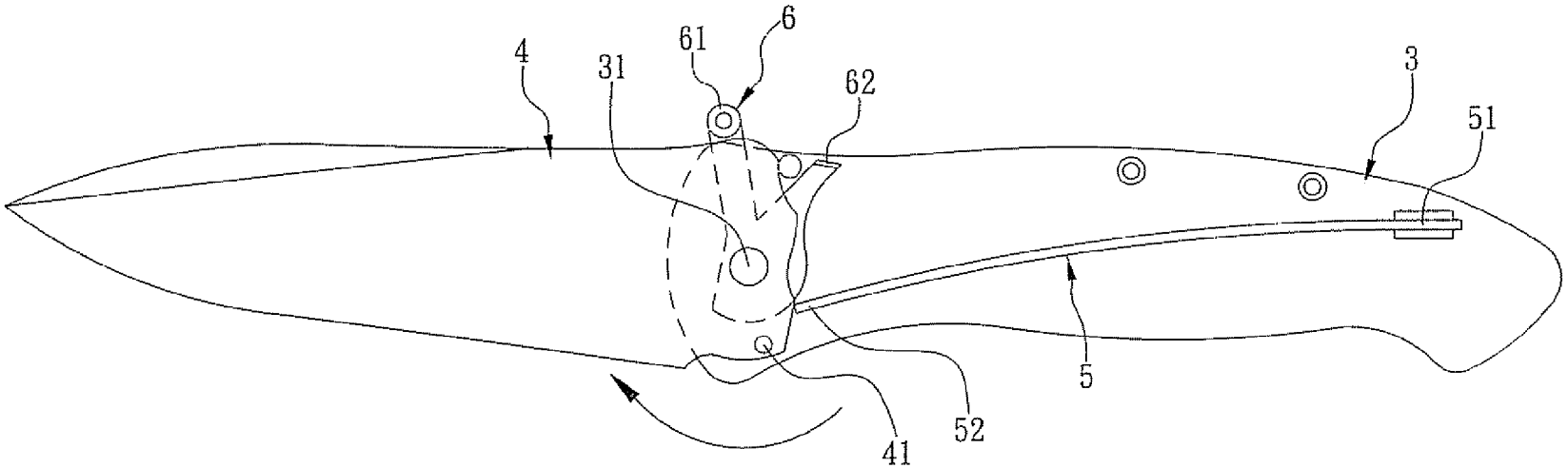
FIG. 3 is a section view of a folding knife being unfolded in accordance with a first preferred embodiment of the present invention.

Referring to FIGS. 2 and 3 for a folding knife having a poking element in accordance with a first preferred embodiment of the present invention, the folding knife comprises a handle 3, a blade 4, a resilient element 5 and a poking element 6, and a first end of the blade 4 is pivotally coupled to a first end of the handle 3 at a first connecting position 31, such that the blade 4 can be turned out of the handle 3 by using the first connecting position 31 as an axis, and the blade 4 can be used for cutting objects, or the blade 4 is turned and stored into the handle 3 to reduce the overall volume of the folding knife for an easy carry and prevent the blade 4 from causing injuries and damages. A first end 51 of the resilient element 5 is fixed to a position proximate to a second end of the handle 3, and a second end 52 of the resilient element 5 is extended to a position proximate to the first connecting position 31, such that when the blade 4 is stored completely into the handle 3 as shown in FIG. 2, the second end 52 of the resilient element 5 will press against a pushing portion 41 of the blade 4 with a first force $F_1$, which is proximate to the first connecting position 31 and is a protruding pillar installed on the blade 4 as shown in FIGS. 2 and 3, to produce a first torque $T_1$ to turn the blade 4 into the handle 3, and store the blade 4 securely into the handle 3. When a force is applied to the blade 4 to turn the blade 4 out from the handle 3 to a predetermined angle θ, the second end 52 of the resilient element 5 pushes against the pushing portion 41 of the blade 4 with a second force $F_2$ to produce a second torque $T_2$ in a direction opposite to the first torque to the blade 4 to turn the blade 4 out of the handle 3 and the blade 4 will be popped out from the handle 3 automatically as shown in FIG. 3, wherein when the blade 4 is completely turned out from the handle 3, the second end 52 of the resilient element 5 is no longer in contact with the pushing portion 41 of the blade 4.

Figure 4:
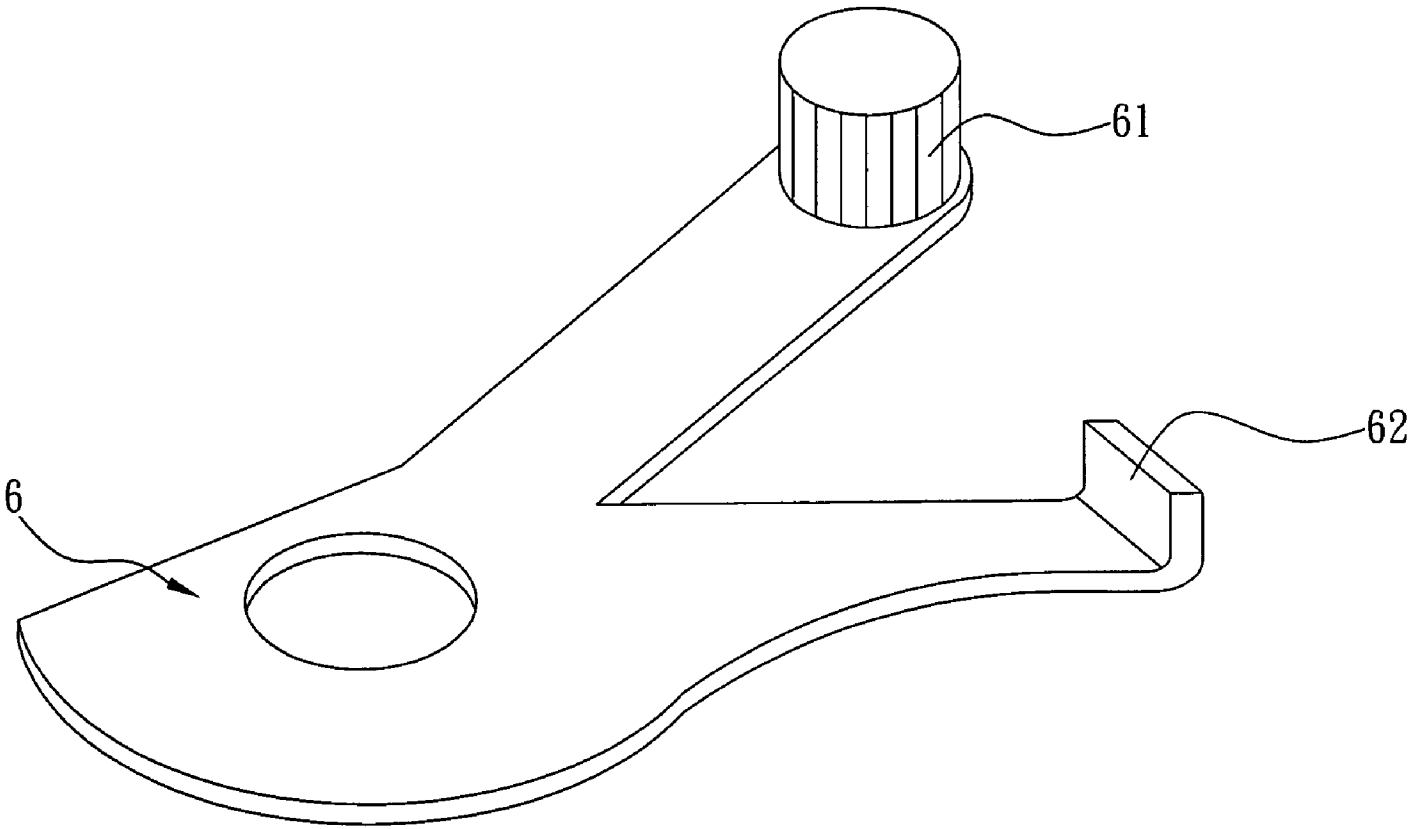
FIG. 4 is a perspective view of a poking element of the present invention.

In the first preferred embodiment as shown in FIGS. 2 and 3, the poking element 6 is pivotally coupled with the handle 3 and the blade 4 as shown in FIG. 4, and the poking element 6 is a sheet body with an end extended out from the handle 3 and having a poking portion 61 protruded from the poking element 6 and provided for users to poke, and another end of the poking element 6 has a pressing portion 62, such that when the blade 4 is stored completely into the handle 3 as shown in FIG. 2, the pressing portion 62 is pressed onto the blade 4, and when the user pokes the poking portion 61 to turn the poking element 6 and drive the pressing portion 62 to exert a force to the blade 4, the blade 4 is turned out from the handle 3 to the predetermined angle θ. By then, the resilient element 5 produces the second torque $T_2$ to turn the blade 4 out of the handle 3, and the blade 4 can be popped out from the handle 3 automatically as shown in FIG. 3. Therefore, the users simply need to hold the handle 3 by one hand, while gently poking the poking portion 61 by a finger to quickly and successfully pop the blade 4 out from the handle to handle the emergency situation, so as to effectively enhance the convenience and safety of using the folding knife.

Figure 5:
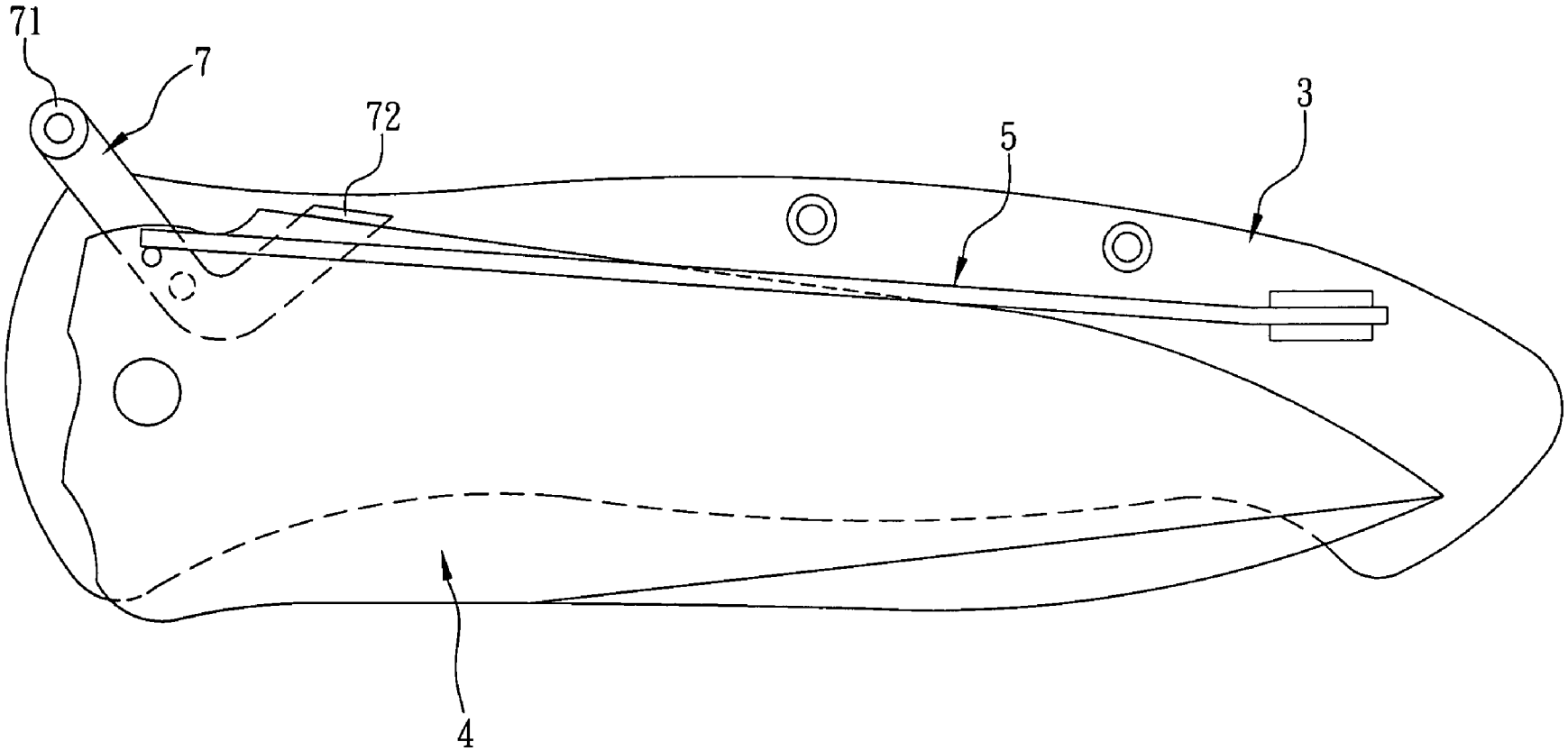
FIG. 5 is a section view of a folding knife being folded in accordance with a second preferred embodiment of the present invention.

Referring to FIG. 5 for a second preferred embodiment of the present invention, a poking element 7 is pivotally coupled to the handle 3 and disposed proximate to a pivotally connecting position of the handle 3 and the blade 4, and an end of the poking element 7 is extended out from the handle 3 and has a poking portion 71 protruded thereon and provided for users to poke the poking element 7, and another end of the poking element 7 has a pressing portion 72, such that when the blade 4 is stored completely into the handle 3, the pressing portion 72 is pressed onto the blade 4. When the user pokes the poking portion 71 as shown in FIG. 5, the poking element 7 is turned to drive the pressing portion 72 to exert a force to the blade 4, and the blade 4 is turned out from the handle 3 to the predetermined angle, such that another end of the resilient element 5 produces a torque to the blade 4 to turn the blade 4 out from the handle 3, and the blade 4 can be popped out from the handle 3 successfully.

Figure 6:
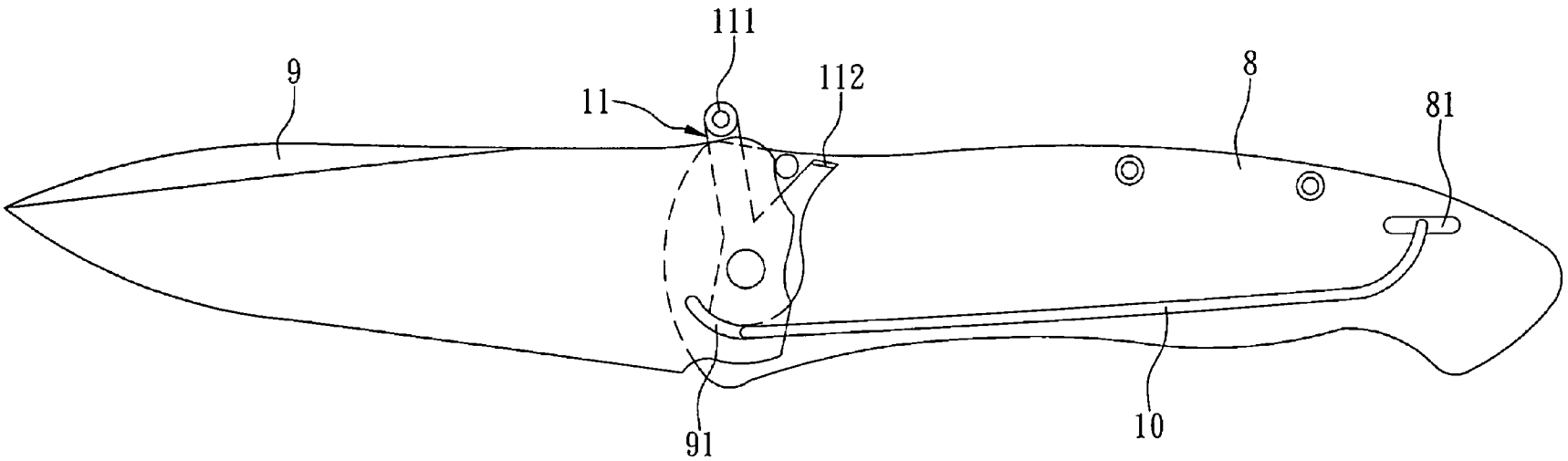
FIG. 6 is a section view of a folding knife being unfolded in accordance with a third preferred embodiment of the present invention.

In a third preferred embodiment of the present invention as shown in FIG. 6, the folding knife comprises a handle 8, a blade 9, a resilient element 10 and a poking element 11, wherein an end of the blade 9 is pivotally coupled to an end of the handle 8, such that the blade 9 can be turned out from the handle 8 by using a pivoting position of the blade 9 and the handle 8 as an axis, or turned and stored into the handle 8. An end of the resilient element 10 is slidably positioned into a positioning slot 81 of the handle 8, and the positioning slot 81 is disposed proximate to another end of the handle 8, and another end of the resilient element 10 is slidably positioned in an arc slot 91 of the blade 9, and the arc slot 91 is disposed on the blade 9 and proximate to a pivotally connecting position of the handle 8 and the blade 9, such that when the blade 9 is stored completely into the handle 8, another end of the resilient element 10 will be pressed into the arc slot 91 to produce a torque to turn the blade 9 into the handle 8, and the blade 9 can be stored securely in the handle 8. When a force is applied to the blade 9 to turn the blade 9 out from the handle 8 to a predetermined angle, the resilient element 10 produces a torque to turn the blade 9 out from the handle 8, and the blade 9 can be popped out from the handle 8 automatically as shown in FIG. 6. The poking element 11 is pivotally coupled with the handle 8 and the blade 9, and an end of the poking element 11 is extended out from the handle 8 and has a poking portion 111 provided for users to poke, and another end of the poking element 11 has a pressing portion 112, such that when the blade 9 is stored completely into the handle 8, the pressing portion 112 is pressed onto the blade 9. If a user pokes the poking portion 111, the poking element 11 will be turned to drive the pressing portion 112 to exert a force onto the blade 9, such that when the blade 9 is turned out from the handle 8 to the predetermined angle, the resilient element 10 produces a torque to turn the blade 9 out from the handle 8, and the blade 9 can be popped out from the handle 8 automatically.

In summation of the description above, embodiments are used for illustrating the present invention, but the actual implementation of the invention is not limited to these embodiments only, numerous modifications and variations could be made to the shape or structure of the resilient element or the connecting relation between the resilient element with the handle and the blade. As long as the resilient element can produce a torque to turn the blade into the handle when the blade is stored completely into the handle, and store the blade securely into the handle, or when a force is applied to the blade to turn the blade out from the handle to a predetermined angle, the resilient element can produce a torque to turn the blade out from the handle and pop the blade out from the handle automatically, such resilient element is the one referred by the invention, and numerous modifications and variations can be made easily by those skilled in the art without departing from the scope and spirit of the invention set forth in the claims.

What is claimed is:

1. A folding knife, comprising:

a handle;

a blade, with a first end pivotally coupled to a first end of the handle at a first connecting position, wherein the blade is able to be pivotally moved out from the handle or moved into the handle;

a resilient element, with a first end fixed on a place proximate to a second end of the handle, wherein a second end of the resilient element is extended to a position proximate to the first connecting position, such that when the blade is completely moved into the handle, the second end of the resilient element pushes against a pushing portion of the blade and produces a first torque to the blade to keep the blade received in the handle, and when the blade is turned away from the handle to a predetermined angle, the second end of the resilient element pushes against the pushing portion of the blade and produces a second torque in a direction opposite to the first torque to the blade to turn the blade completely out from the handle, wherein when the blade is completely turned out from the handle, the second end of the resilient element is no longer in contact with the pushing portion of the blade; and a poking element, pivotally coupled to the handle at the first connecting position, wherein the poking element has a body portion, a first leg extended out from the handle to a position outside a rotating range of the blade and having a protruding poking portion formed thereon, and a second leg of the poking element has a pressing portion for pressing onto the blade when the blade is completely moved into the handle, wherein the first leg and the second leg join at the body portion to form substantially a "V" shape;

thereby, when the protruding poking portion is poked by a user, the pressing portion exerts a force to the blade to turn the blade away from the handle to the predetermined angle, such that in turn the resilient element causes the blade to be completely turned out from the handle automatically.

2. The folding knife of claim 1, wherein the poking element is pivotally coupled to the handle via the body portion.

* * * * *